US005353864A

United States Patent [19]

Greenland et al.

[11] Patent Number: 5,353,864

[45] Date of Patent: Oct. 11, 1994

[54] MASS FLOW COOLER

[75] Inventors: Harvey R. Greenland, Hatboro; John A. Canterbury, Doylestown, both of Pa.

[73] Assignee: FMC Corporation, Chicago, Ill.

[21] Appl. No.: 24,702

[22] Filed: Mar. 1, 1993

[51] Int. Cl.[5] ..... F28F 27/00; F28D 7/00

[52] U.S. Cl. ..... 165/96; 165/84; 165/142; 165/162; 165/920; 34/177; 422/146

[58] Field of Search ..... 165/84, 96, 142, 920, 165/162; 422/146; 34/64, 65, 164, 167, 177

[56] References Cited

U.S. PATENT DOCUMENTS

| | | | |
|---|---|---|---|
| Re. 33,528 | 1/1991 | Doty . | |
| 121,746 | 12/1871 | Bauman . | |
| 409,287 | 8/1889 | Immendorf . | |
| 969,484 | 9/1910 | Koegler | 34/167 |
| 971,559 | 10/1910 | Provost | 34/167 |
| 1,303,088 | 5/1919 | McCraig et al. . | |
| 2,475,025 | 7/1949 | Huff | 422/146 |
| 2,505,695 | 4/1950 | Villiger et al. | 165/162 |
| 2,703,225 | 3/1955 | Cooper | 165/96 |
| 2,926,428 | 3/1960 | Adam et al. . | |
| 3,003,667 | 10/1961 | Jonsson | 34/164 |
| 3,026,626 | 3/1962 | Smith | 34/177 |
| 3,292,691 | 12/1966 | Welter et al. | 165/162 |
| 3,866,673 | 2/1975 | Pavlov et al. | 165/96 X |
| 4,066,247 | 1/1978 | Mendenall | 165/84 X |
| 4,176,710 | 12/1979 | Gansavge et al. | 422/146 X |
| 4,450,904 | 5/1984 | Volz | 165/162 |
| 4,546,821 | 10/1985 | Kummel . | |
| 5,079,459 | 1/1992 | Huston et al. | 165/84 X |

FOREIGN PATENT DOCUMENTS

| | | | |
|---|---|---|---|
| 444338 | 4/1991 | European Pat. Off. . | |
| 1205565 | 11/1965 | Fed. Rep. of Germany | 165/84 |

*Primary Examiner*—John Rivell
*Assistant Examiner*—L. R. Leo
*Attorney, Agent, or Firm*—Henry C. Query, Jr.; Richard B. Megley

[57] ABSTRACT

A mass flow cooler for cooling particulate material comprising a vertical bin having a top end, a bottom end, a material inlet near the top end and a material discharge in the bottom end; the material discharge comprising a plurality of orifices through which the particulate material may flow; a plurality of vertical, tubular heat exchanger elements, each having an open top end and a sealed bottom end and extending from the top of the bin toward the bottom of the bin; a plurality of fluid distribution tubes corresponding to the number of heat exchanger elements, each fluid distribution tube having an open top end and an open bottom end and extending through the top end of a corresponding heat exchanger element toward the bottom end of the heat exchanger element; each fluid distribution tube being connected to a source of cooling fluid; and a discharge orifice plate positioned below the material discharge for controlling the rate at which the material flows through the bin.

5 Claims, 5 Drawing Sheets

MASS FLOW COOLER

BACKGROUND OF THE INVENTION

1. Field of the Invention

The present invention relates to an apparatus for cooling particulate materials and, more particularly, to a mass flow cooler wherein particulate material is fed into a vertical bin through an inlet near the top thereof, descends uniformly by force of gravity past a plurality of vertical cooling elements, and is controllably discharged from the bottom of the cooler.

2. Description of Related Art

The production of certain particulate materials, such as potash and phosphates, requires that the materials be cooled to, for example, avoid caking. Mass flow coolers have been developed to reduce energy and maintenance costs as well as avoid the attrition and abrasion problems experienced with rotating drum or fluidized bed cooling devices. These mass flow coolers typically comprise a vertical housing or bin with an opening at the top through which the material to be cooled is introduced, one or more heat exchanger elements for cooling the material and a discharge hopper at the bottom of the bin to control the flow of the material through the bin. Such a cooler is disclosed in U.S. Pat. No. 4,546,821 issued to Kummel. The problem with Kummel, however, is that the design of the heat exchanger element may interfere with the flow of material through the bin and yet not provide for uniform cooling of the material. In addition, the discharge mechanism may not promote the effective mass flow of material through the bin. Another embodiment of a mass flow cooler, disclosed in European Patent Application number 90302189.7, utilizes a multiplicity of parallel, spaced, vertical heat exchanger plates to cool the material. These plates interfere with the lateral flow of material through the bin and are relatively difficult to manufacture and incorporate into the cooler. In addition, the flow channels within the plates and the rest of the cooler define a closed system for the cooling fluid which could result in a dangerous pressure buildup should the flow of fluid stop. Furthermore, the amount of material being discharged from the bin should not be greater than the amount of material being fed into the bin to ensure that the material completely fills the bin so that cooling is uniform and cooling efficiency can be maintained at all times.

SUMMARY OF THE INVENTION

Therefore, it is an object of the present invention to provide a mass flow cooler that does not significantly interfere with the flow of particulate material therethrough. It is another object of the invention to provide such a cooler in which the heat exchanger elements are uniformly distributed within the bin to achieve uniform cooling of the material. It is a further object of the invention to provide a mass flow cooler wherein the cooling fluid is open to atmosphere to eliminate the possibility of a dangerous pressure buildup within the heat exchanger elements. It is yet another object of the invention to provide a mass flow cooler with a flexible discharge system for controlling the discharge of material through the bin to maintain a constant desired amount of material within the bin at all times.

According to the present invention, these and other objects and advantages are achieved by providing a mass flow cooler which comprises a vertical bin having a material inlet near its top end and a material discharge at its bottom end; a plurality of vertical, tubular heat exchanger elements having open top ends and sealed bottom ends and extending from the top of the bin substantially to the material discharge; a corresponding number of thin fluid distribution tubes extending within the heat exchanger elements from just above the open tops to almost the bottom ends thereof; a fluid distribution manifold connected to the top of the bin and communicating with a source of cooling fluid; a plurality of flexible hoses extending between the distribution manifold to each of the fluid distribution tubes; a fluid drain communicating with the open top ends of the heat exchanger elements; a discharge orifice plate located below the material discharge end of the bin; suspension means connected to the discharge orifice plate that can be adjusted to vary the distance between the material discharge and the orifice plate; and a vibrator connected to the orifice plate to control the flow of material through the bin.

In operation, particulate material to be cooled is introduced through the material inlet and descends around the tubular heat exchanger elements, which are uniformly spaced throughout the cross sectional area of the bin. The material freely flows laterally around the heat exchanger elements and uniformly fills the entire cross section of the bin. Cooling fluid is pumped from a source through the distribution manifold and flexible hoses to each fluid distribution tube. The fluid is pumped down the distribution tubes and flows up between the distribution tubes and the interior of the corresponding heat exchanger elements to thereby cool the material. The pressure drop over the length of the distribution tubes is sufficient to ensure a uniform countercurrent flow through all of the heat exchanger elements. The uniform distribution and flow of material around the heat exchanger elements and the uniform flow of cooling fluid within the heat exchanger elements results in uniform cooling of the material. Heated cooling fluid exits through the tops of the heat exchanger elements and is carried away by the fluid drain. The tops of the heat exchanger elements are open to atmosphere to prevent a potentially dangerous pressure buildup within the heat exchanger elements. The cooled particulate material flows through the material discharge at the bottom of the bin and through the discharge orifice plate to a discharge hopper. The flow of material through the material outlet and, thus, the bin can be fairly precisely controlled by changing the vibration frequency and/or amplitude of the vibrator. Changing the distance between the material discharge and the discharge orifice plate allows for flexibility in handling materials with different characteristics.

In another embodiment of the invention, a means for detecting the height of material in the bin is connected to a process controller which controls the vibration frequency and/or amplitude of the vibrator to thereby automatically maintain a desired height or amount of material in the bin.

These and other objects and advantages of the present invention will be made apparent from the following detailed description, with reference to the accompanying drawings.

DETAILED DESCRIPTION OF THE PREFERRED EMBODIMENTS

Figure 1:
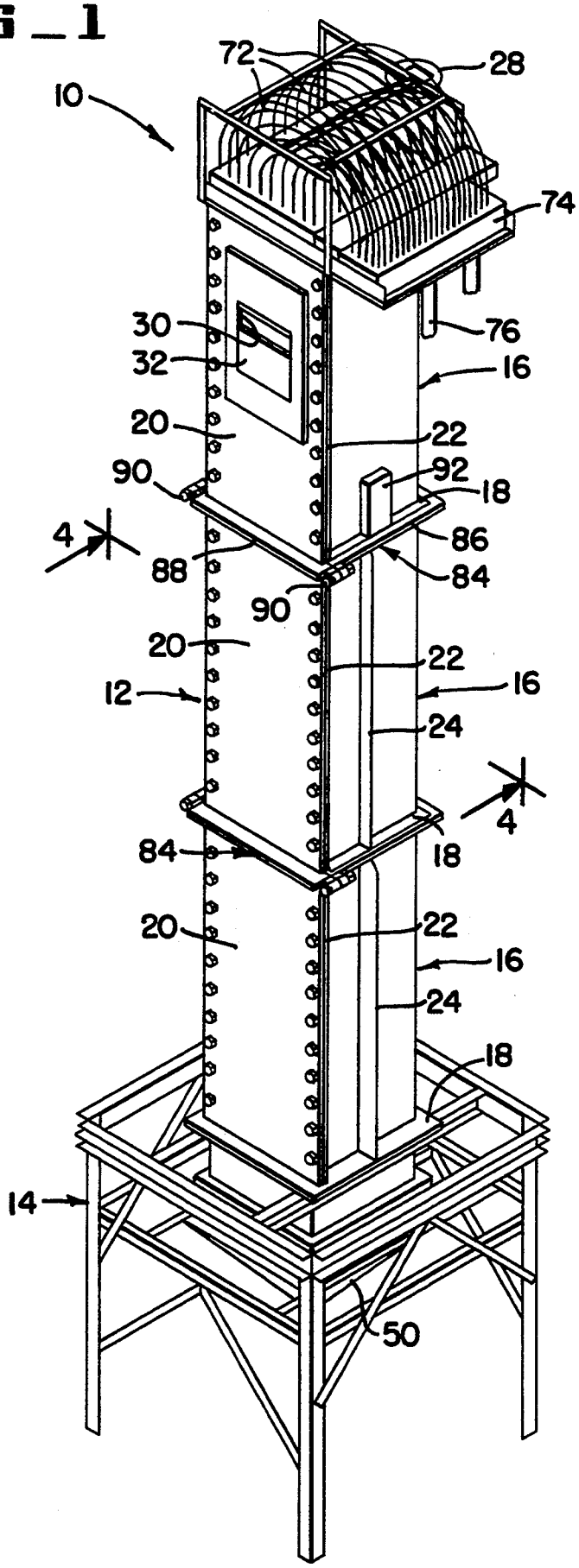
FIG. 1 is a perspective view of the mass flow cooler of the present invention.

Referring to FIG. 1, the mass flow cooler of the present invention, indicated generally by reference numeral 10, is shown to comprise a vertical housing or bin 12 mounted on a support structure 14. In the embodiment of the invention depicted in FIG. 1, bin 12 is comprised of three vertical bin sections 16, which are joined together with bolts, or any other appropriate means, through flanges 18 formed at or connected to the ends of each bin section 16. Each bin section 16 also comprises a front panel 20 which is bolted to flanges 22 formed at or connected to the side edges of bin section 16. While bin 12 is depicted in FIG. 1 as having a rectangular cross section, it could comprise any practical cross section, such as a circular cross section. In addition, while the dimensions of bin 12 may be variable, a height of forty feet and a width and depth of two feet are preferable. Bin 12 is preferably constructed of steel to give it the rigidity required to both contain the particulate material and withstand external forces caused by wind and the like. In addition, side braces 24 may be welded to the sides of one or more bin sections 16 to enhance the lateral strength of bin 12. Support structure 14 is preferably constructed of angle and channel iron to give it the strength required to support the weight of bin 12 and the particulate material within bin 12.

Figure 2:
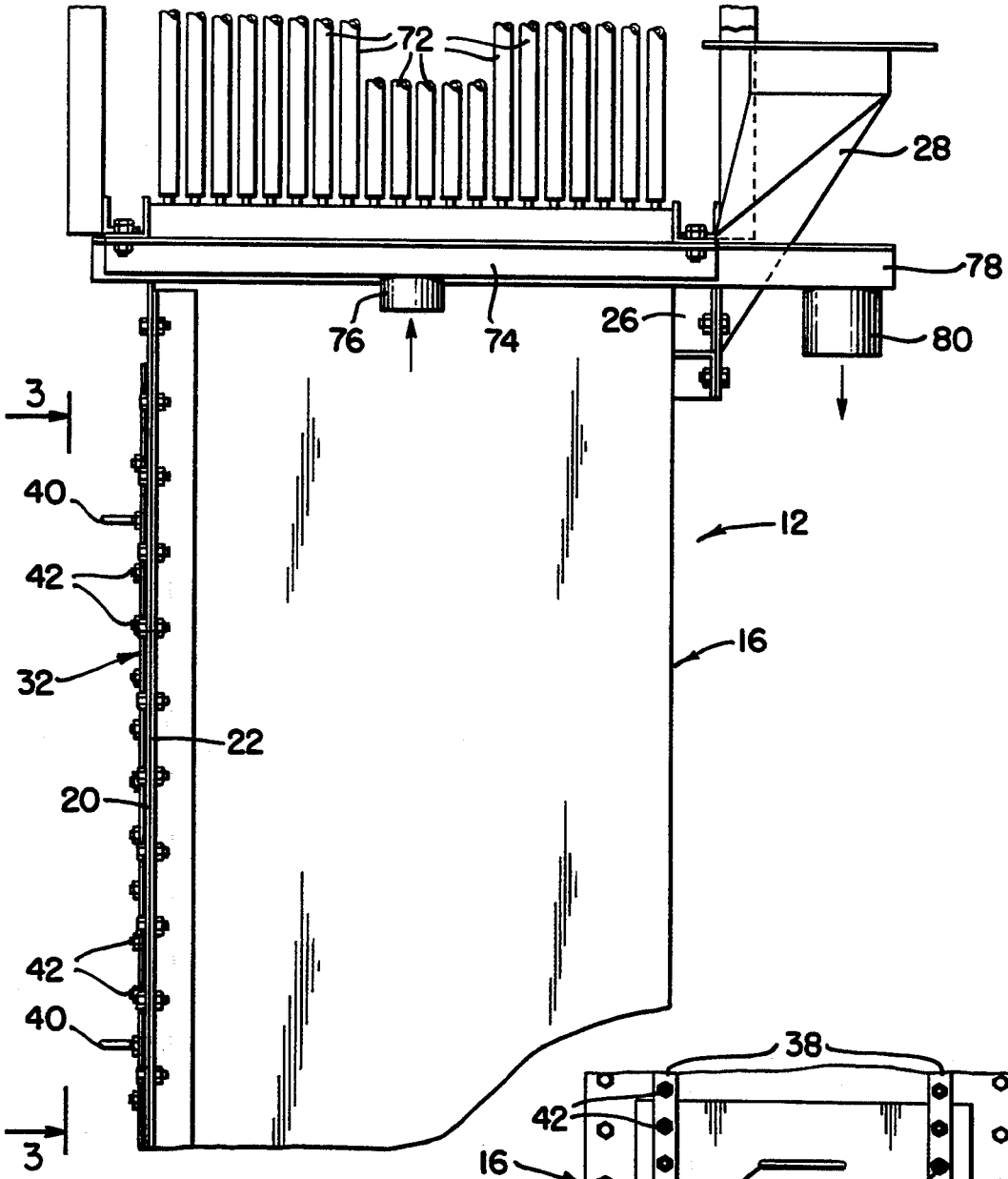
FIG. 2 is a partial side elevation view of the top portion of the mass flow cooler of the present invention.
Figure 3:
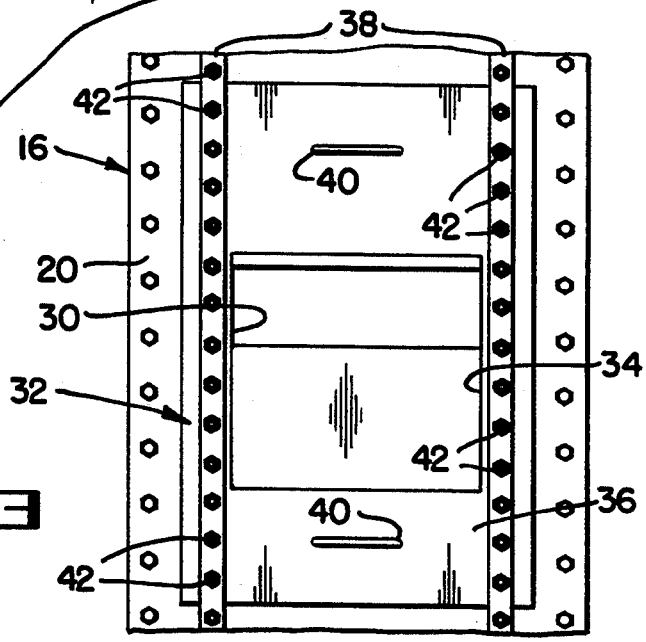
FIG. 3 is a partial front elevation view taken along line 3—3 of FIG. 2.

Referring to FIGS. 1, 2 and 3, bin 12 further comprises a material inlet 26 near its top end and an infeed chute 28 adjacent inlet 26 to help direct particulate material into inlet 26. Bin 12 also comprises a longitudinal opening 30 formed in the top bin section 16 opposite inlet 26 and an overflow gate 32 slidably secured over opening 30. Referring to FIG. 3, overflow gate 32 comprises a rectangular opening 34 formed in a substantially flat plate 36 that is slidably mounted behind bars 38 connected to front panel 20. Handles 40 connected to plate 36 allow gate 32 to be manually positioned vertically so that opening 34 may be adjusted up or down. Once gate 32 is positioned as desired, one or more bolts 42 extending through bars 38 are tightened against plate 36 to maintain gate 32 in the desired position. The purpose of gate 32 will be made more apparent below.

Figure 4:
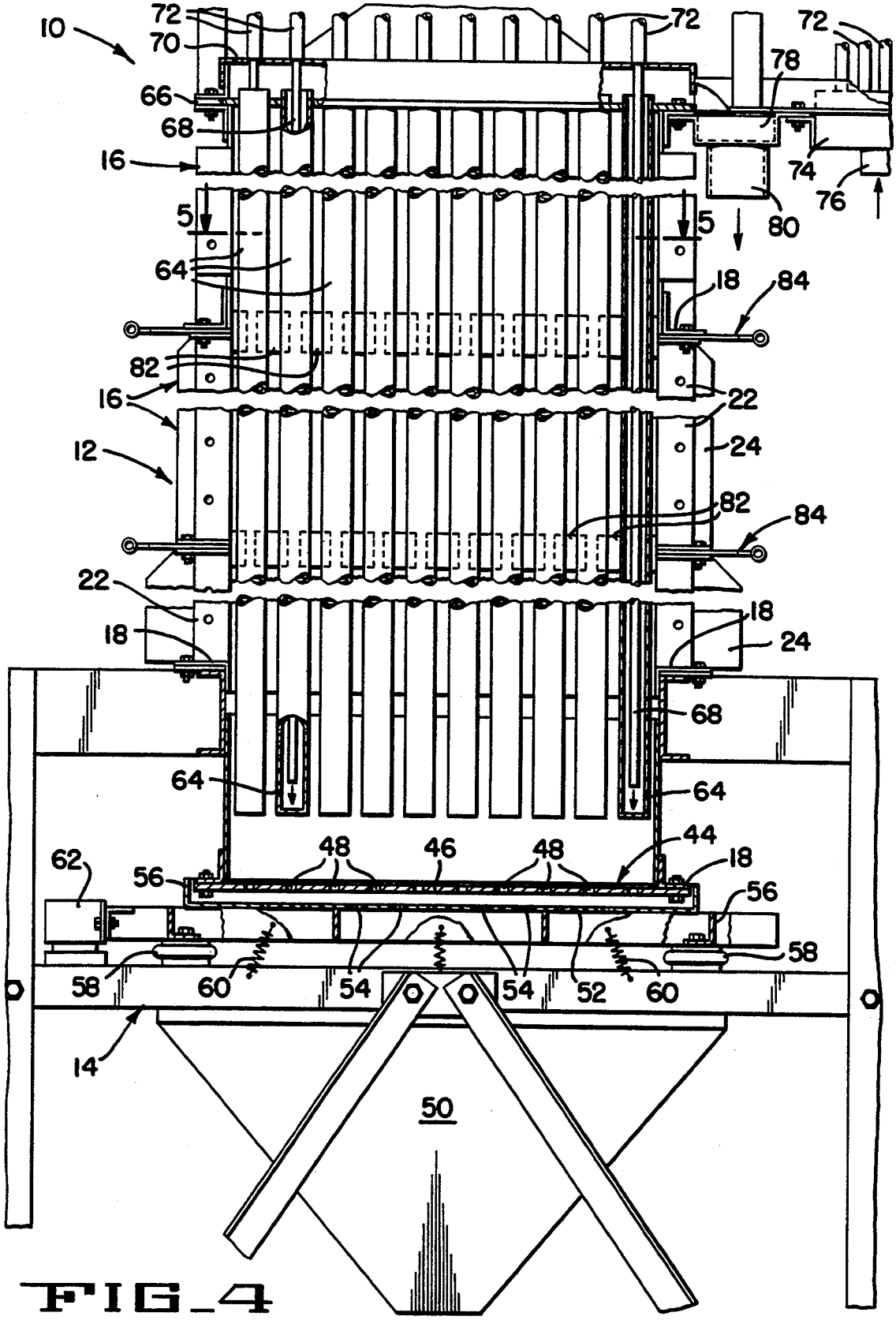
FIG. 4 is a partial vertical sectional view taken along line 4—4 of FIG. 1.

Referring to FIG. 4, bin 12 also comprises a material discharge 44 at its bottom end. Discharge 44 is preferably constructed of a metal plate 46, which is bolted to flanges 18 of the lowermost bin section 16, and comprises a plurality of apertures 48 in plate 46. Mass flow cooler 10 also comprises a discharge hopper 50 connected to support structure 14 below discharge 44 and a discharge orifice plate 52 positioned between discharge 44 and hopper 50. Orifice plate 52 comprises a number of orifices 54 which are preferably offset from apertures 48 and spaced such that four orifices 54 are equidistant to each aperture 48. Orifice plate 52 also comprises sides 56 formed at each of its edges to contain the particulate material passing through discharge 44. Orifice plate 52 is connected to support structure 14 through suspension means 58, such as air suspension springs, for adjustably raising and lowering orifice plate 52 to vary the distance between orifice plate 52 and discharge 44. A number of springs 60 extending between support structure 14 and orifice plate 52 function to urge orifice plate 52 downward against air springs 58 so that, when air is selectively released from air springs 58, the distance between orifice plate 52 and discharge 44 will be increased. Mass flow cooler 10 further comprises a vibrator 62 for vibrating orifice plate 52. Vibrator 62 is connected to one side 56 of orifice plate 52 and is preferably adjustable to vary the frequency and amplitude of the vibrations imparted to orifice plate 52.

Referring still to FIG. 4, mass flow cooler 10 also comprises a plurality of vertical, tubular heat exchanger elements 64 extending from the top of bin 12 to just above discharge 44. Heat exchanger elements 64 are suspended from a plate 66 which is bolted to flanges 18 of the top bin section 16. Heat exchanger elements 64 are connected to plate 66 by any appropriate means, such as by welding. The top end of each heat exchanger element 64 is open, but the bottom end is closed off to form a fluid-tight seal. Heat exchanger elements 64 are constructed of a material, such as metal, that will allow heat to be easily conducted across the surfaces thereof. For simplicity of construction, heat exchanger elements 64 are preferably constructed of metal pipe.

Cooling fluid is distributed to each of the heat exchanger elements 64 through a number of fluid distribution tubes 68, one for each heat exchanger element 64. Tubes 68 have a diameter approximately one-fourth the diameter of heat exchanger elements 64, extend through the open top ends to just above the sealed bottom ends of heat exchanger elements 64, and are suspended from a support plate 70 spaced above plate 66 at the top of bin 12. Tubes 68 extend slightly through corresponding holes in plate 70 and are secured thereto by any appropriate means, such as clamps. In addition tubes 68 are open at both their top and bottom ends and are constructed of a material that has a low thermal conductivity, such as plastic or PVC, so that heat conducted across the heat exchanger elements will not be transferred to the cooling fluid flowing through tubes 68. The top end of each tube 68 is connected to one end of a flexible hose 72, the other end of which is connected to a fluid distribution manifold 74 which receives cooling fluid from an external source (not shown) through a supply pipe 76 (FIGS. 1, 2 and 4). The cooling fluid is pumped from the external source through supply pipe 76, manifold 74, hoses 72 and tubes 68. The fluid exits the open bottom ends of tubes 68 and is directed upward between tubes 68 and the interior of corresponding heat exchanger elements 64. The pressure drop down the length of tubes 68 is sufficient to ensure that the upward flow in all the heat exchanger elements 64 is uniform, regardless of the variations in pressure in the cooling fluid at the tops of tubes 68. The fluid is discharged through the open top ends of heat exchanger elements 64 and is directed by plate 66 into a gutter 78 and out through a fluid return pipe 80 (FIGS. 2 and 4). Gutter 78 is open at its top to prevent a potentially dangerous pressure buildup in the cooling fluid within heat exchanger elements 64. In addition, as is apparent from the above description, the fluid distribution system does not comprise any connections within bin 12. Therefore, there is no risk that the fluid will leak into the material to be cooled.

Figure 5:
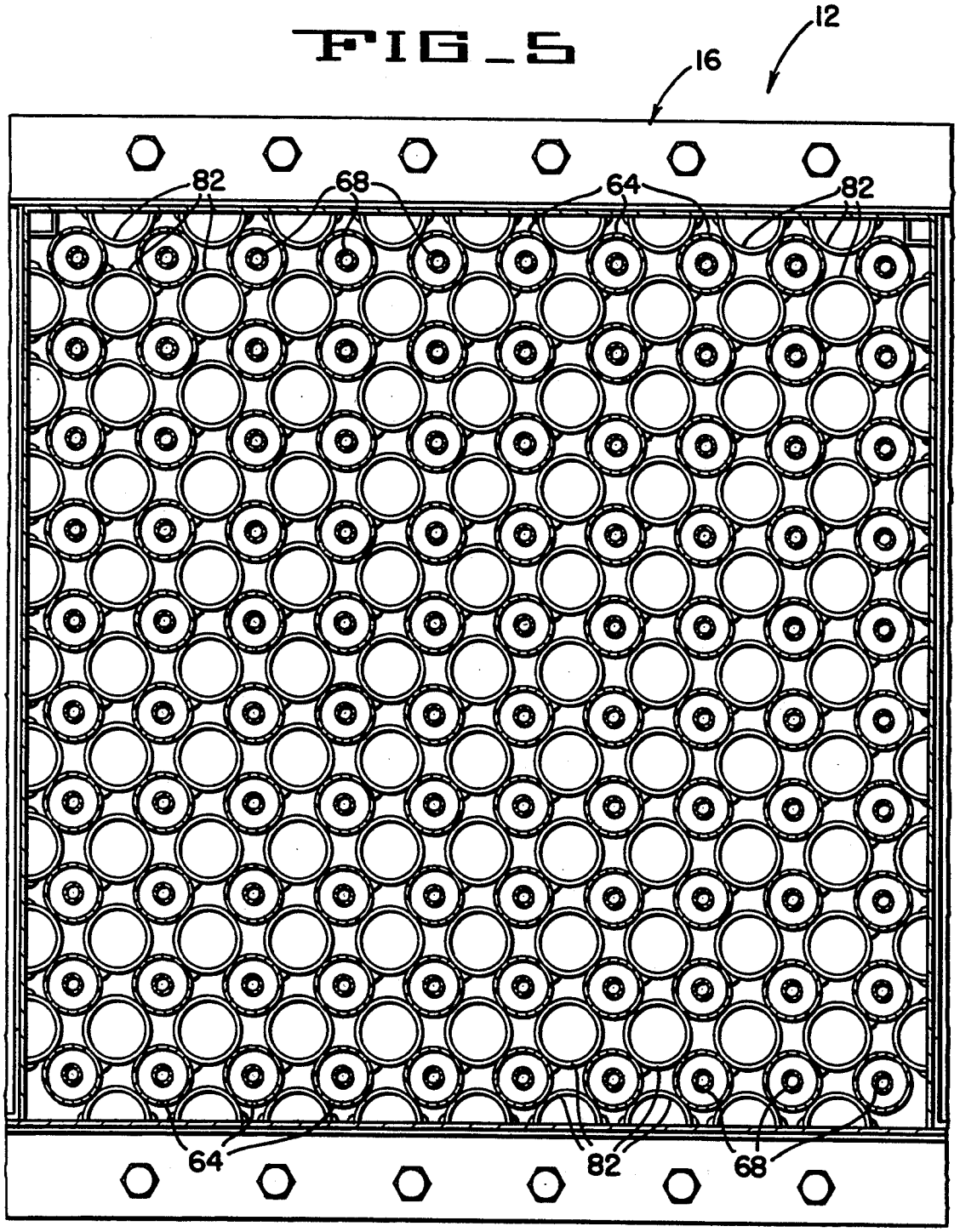
FIG. 5 is a partial cross sectional view taken along line 5—5 of FIG. 4.

As is apparent from FIG. 5, heat exchanger elements 64 are uniformly spaced throughout the cross section of bin 12. The spacing between adjacent heat exchanger elements 64 is maintained by a plurality of annular spacer elements 82. In the embodiment depicted in FIG. 4, two rows of spacers 82 are employed. Each spacer 82 is welded to only one adjacent heat exchanger element 64 so that individual heat exchanger elements 64 may thermally expand and contract without interference. Proximate each row of spacers 82 is a lateral brace 84, each of which comprises a U-shaped yoke 86 mounted between the adjacent flanges of bin sections 16 and a closure member 88 connected to yoke 86 by means of two bolts 90 (FIG. 1). Tightening bolts 90 compresses heat exchanger elements 64 and corresponding spacers 82 between closure member 88 and yoke 86 to maintain these elements in firm engagement.

Mass flow cooler 10 preferably also comprises a pneumatic impactor 92, or similar means, for automatically imparting periodic vibrations or shocks to bin 12. Impactor 92 is mounted to a flange 18 adjacent one of the braces 84. Due to the tight interlock between heat exchanger elements 64 and spacers 82 created by braces 84, the vibrations from impactor 92 are effectively transferred throughout bin 12 and heat exchanger elements 64 to promote uniform mass flow of the particulate material through bin 12 and prevent bridging and "rat-holing". Instead of or in addition to impactor 92, cooler 10 could comprise an air cannon or similar means for directly agitating the material within bin 12.

Figure 6:
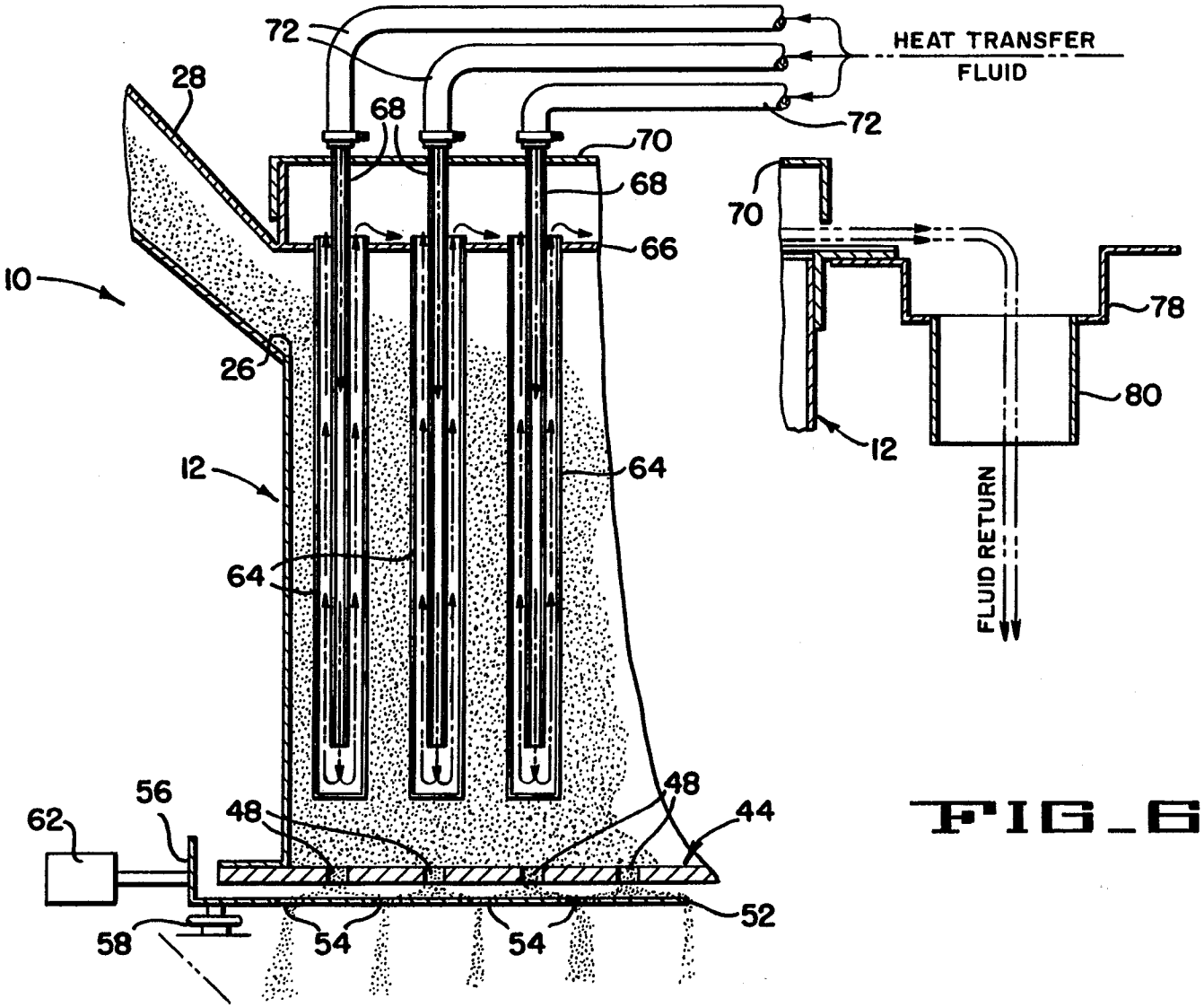
FIG. 6 is a schematic representation of the invention showing the flow of material and cooling fluid therethrough.

The operation of cooler 10 is described with reference to FIG. 6, as well as the other figures. In operation, particulate material to be cooled is fed down chute 28, through material inlet 26 and into bin 12. The material descends uniformly around all of the heat exchanger elements 64 and fills the entire cross section of bin 12. The material then exits bin 12 through discharge end 44 and accumulates on discharge orifice plate 52. Suspension means 58 are employed to vary the distance between discharge orifice plate 52 and discharge end 44, depending on the characteristics of the material, to ensure that the material backs up onto orifice plate 52. Vibrator 62 is then activated to discharge the material through orifice plate 52. Overflow gate 32 is positioned to maintain the maximum material level in bin 12 without causing the material to back up in chute 28. Once the material begins spilling through opening 34 in gate 32, the frequency and/or amplitude of vibrator 62 are adjusted to maintain the desired material flow rate through bin 12. As the particulate material is flowing through bin 12, its heat will be transferred through the surfaces of heat exchanger elements 64 and the material will be cooled. The uniform counter-current flow of cooling fluid through all of the heat exchanger elements 64 will ensure that the material is cooled uniformly.

In another embodiment of the invention, instead of comprising an opening 30 and overflow gate 32 to ensure that a maximum amount of material is contained in bin 12 at all times, cooler 10 comprises a means for sensing the amount of material in bin 12 connected in a control Iccp to a process controller and vibrator 62. In this embodiment, signals from the sensing means are fed to the process controller, which in turn is programmed to control the frequency and/or amplitude of vibrator 62 in response to the signals from the sensing means to maintain a mass flow condition in bin 12. The sensing means can be any of a number of devices which serve the stated function, such as a photo detector, which is positioned at the top of bin 12 at the desired level and will signal the process controller when the level of material in bin 12 falls below that level, or a Icad cell, which is mounted to the bottom of bin 12 and will provide a signal representative of the weight of the material in bin 12. The process controller is programmed in a known manner to generate output signals to vibrator 62 in response to signals from the sensing means indicating that the level of material in bin 12 is above or below a desired level. The output signals in turn prompt an increase or decrease in the frequency and/or amplitude of vibrator 62 sufficient to maintain the level of material in bin 12 at the desired level.

In another embodiment of the present invention, two or more and preferably four bins 12 are mounted upon a single support structure 14 over a single discharge hopper 50. Bins 12 are mounted in a ring or box-like conformation such that their infeed chutes 28 are positioned toward the interior of the ring. A single means can then be employed to feed particulate material to each of the infeed chutes 28, either successively or simultaneously. All other aspects of this embodiment of the mass flow cooler are identical with the description provided above, the purpose of this embodiment being to provide a cooler which can process a greater volume of particulate material.

It should be recognized that, while the present invention has been described in relation to the preferred embodiments thereof, those skilled in the art may develop a wide variation of structural details without departing from the principles of the invention. Therefore, the appended claims are to be construed to cover all equivalents falling within the true scope and spirit of the invention.

What is claimed is:

1. An apparatus for cooling particulate material comprising:

a vertical bin having a top end, a bottom end, a material inlet near the top end and a material discharge in the bottom end;

the material discharge comprising a plurality of orifices through which the particulate material may flow;

a plurality of vertical, tubular heat exchanger elements, each having an open top end and a sealed bottom end and extending from the top of the bin toward the bottom of the bin;

a plurality of fluid distribution tubes corresponding to the number of heat exchanger elements, each fluid distribution tube having an open top end and an open bottom end and extending through the top end of a corresponding heat exchanger element toward the bottom end of the heat exchanger element;

the top end of each fluid distribution tube being connected to a source of cooling fluid;

means positioned below the material discharge for controlling the rate at which the material flows through the bin;

wherein the means for controlling comprises a discharge plate having a plurality of orifices extending therethrough;

wherein the means for controlling further comprises means for vibrating the discharge plate;

wherein the means for vibrating is selectively adjustable to control the frequency or amplitude of the vibrations; and means for sensing the amount of material within the bin and controller means responsive to the sensing means for controlling the means for vibrating.

2. An apparatus for cooling particulate material comprising:

a vertical bin having a top end, a bottom end, a material inlet near the top end and a material discharge in the bottom end;

the material discharge comprising a plurality of orifices through which the particulate material may flow;

a plurality of vertical, tubular heat exchanger elements, each having an open top and a sealed bottom end and extending from the top of the bin toward the bottom of the bin;

a plurality of fluid distribution tubes corresponding to the number of heat exchanger elements, each fluid distribution tube having an open top end and an open bottom end and extending through the top end of a corresponding heat exchanger element toward the bottom end of the heat exchanger element;

the top end of each fluid distribution tube being connected to a source of cooling fluid;

means positioned below the material discharge for controlling the rate at which the material flows through the bin;

wherein the means for controlling comprises a discharge plate having a plurality of orifices extending therethrough;

wherein the means for controlling further comprises means for selectively raising and lowering the discharge plate; and wherein the means for selectively raising and lowering comprises air suspension springs.

3. An apparatus for cooling particulate material comprising:

a vertical bin having a top end, a bottom end, a material inlet near the top end and a material discharge in the bottom end;

the material discharge comprising a plurality of orifices through which the particulate material may flow;

a plurality of vertical, tubular heat exchanger elements, each having an open top end and a sealed bottom end and extending from the top of the bin toward the bottom of the bin;

a plurality of fluid distribution tubes corresponding to the number of heat exchanger elements, each fluid distribution tube having an open top end and an open bottom end and extending through the top end of a corresponding heat exchanger element toward the bottom end of the heat exchanger element;

the top end of each fluid distribution tube being connected to a source of cooling fluid;

means positioned below the material discharge for controlling the rate at which the material flows through the bin;

a plate connected to the top of the bin from which the heat exchanger elements are suspended and onto which the cooling fluid exiting the heat exchanger elements is discharged; and a gutter in fluid communication with the plate, the gutter being open to ambient atmosphere.

4. An apparatus for cooling particulate material comprising:

a vertical bin having a top end, a bottom end, a material inlet near the top end and a material discharge in the bottom end;

the material discharge comprising a plurality of orifices through which the particulate material may flow;

a plurality of vertical, tubular heat exchanger element, each having an open top end and a sealed bottom end and extending from the top of the bin toward the bottom of the bin;

a plurality of fluid distribution tubes corresponding to the number of heat exchanger elements, each fluid distribution tube having an open top end and an open bottom end and extending through the top end of a corresponding heat exchanger element toward the bottom end of the heat exchanger element;

the top end of each fluid distribution tube being connected to a source of cooling fluid;

means positioned below the material discharge for controlling the rate at which the material flows through the bin; and spacer means for maintaining a desired spacing between the periphery of the bin and the adjacent heat exchanger elements and between adjacent heat exchanger elements without interfering significantly with the flow of material through the bin; and brace means proximate the spacer elements for ensuring a firm engagement between the heat exchanger elements and the spacer elements.

5. The apparatus of claim 4, further comprising a means for imparting periodic shocks to the bin connected to the bin adjacent the brace means, whereby the shocks are transmitted through the spacer elements and the heat exchanger elements.

* * * * *